United States Patent [19]

Noel

[11] 4,445,231

[45] May 1, 1984

[54] BIB HAVING GRAVITATIONALLY OPENABLE POCKET

[75] Inventor: John R. Noel, Cincinnati, Ohio

[73] Assignee: The Proctor & Gamble Company, Cincinnati, Ohio

[21] Appl. No.: 486,573

[22] Filed: Apr. 19, 1983

[51] Int. Cl.[3] ..... A41B 13/10

[52] U.S. Cl. ..... 2/49 R

[58] Field of Search ..... 2/49 R, 50, 51, 52

[56] References Cited

U.S. PATENT DOCUMENTS

| | | | |
|---|---|---|---|
| D. 169,912 | 6/1953 | Owen | D3/26 |
| 2,164,369 | 7/1939 | Woolever | 2/49 R |
| 3,010,111 | 11/1961 | Ralph | 2/49 |
| 3,146,464 | 9/1964 | Burnett | 2/49 |
| 3,328,807 | 7/1967 | Strauss | 2/49 |
| 3,416,157 | 12/1968 | Marder et al. | 2/49 |
| 3,995,321 | 12/1976 | Johnson | 2/49 R |
| 4,233,688 | 11/1980 | Hjerl | 2/49 R |
| 4,261,057 | 4/1981 | Anderson | 2/49 R |

*Primary Examiner*—Troutman Doris L.
*Attorney, Agent, or Firm*—Thomas J. Slone; Fredrick H. Braun; Richard C. Witte

[57] ABSTRACT

A bib, preferably disposable, having a top panel, a full-width pocket having side seams, and an apron panel which pendulously depends from the transverse upper edge of the front wall of the pocket (i.e., a pocket panel) so that the weight of the apron panel acts to gravitationally open the pocket and hold it open, and so that the apron panel may be used as a face wipe without inverting the pocket. Gravitational opening of the pocket is further enabled by virtue of the transverse upper edge of the pocket panel being disposed at a higher elevation than the top ends of the side seams of the pocket when viewed with the bib in its use orientation and/or by securing together face-to-face areas of the pocket panel and the apron panel which are disposed adjacent their coextensive upper edges. Preferably such areas which are secured in face-to-face relation are centrally disposed with respect to the width of the bib. Also, preferably, the bib is a unitary structure comprising a sheet of a crease sustaining laminated material having an absorbent front lamina, and wherein the panels are demarked from each other by transverse fold lines which have been creased. Additionally, the bib may further comprise: a duplex refastenable tape fastener; a line-of-weakening to enable detaching all or part of the apron panel for use as a post-use wipe; and a detachable neck-opening portion.

8 Claims, 5 Drawing Figures

BIB HAVING GRAVITATIONALLY OPENABLE POCKET

DESCRIPTION

1. Technical Field

This invention pertains to providing bibs for use on, for example, babies being fed. More particularly, it pertains to providing such bibs with full-width pockets, and apron panels which depend from the transverse top edges of the pockets. As used herein, a full-width pocket is a pocket which, at least at its top, extends substantially the full-width of the bib: i.e., the end-seams of the pocket are coextensive with the side edges of the body panel of the bib or adjacent thereto.

2. Background Art

Background art patents disclose bibs having full-width pockets, and form-sustaining means for opening the pockets and keeping the pockets thereof open during use: for example, U.S. Pat. No. 3,010,111 which issued Nov. 28, 1961 to H. J. Ralph. Bibs having full-width pockets are also shown in the following U.S. Pat. Nos.: 3,146,464 which issued Sept. 1, 1964 to E. N. Burnett; 3,328,807 which issued July 4, 1967 to K. Strauss; 3,416,157 which issued Dec. 17, 1968 to H. L. Marder et al; and 3,995,321 which issued Dec. 7, 1976 to Sally Johnson. In addition, U.S. Pat. No. D. 169,912 which issued June 23, 1953 to H. A. Owen discloses a bib having a full-width pocket which is so configured and disposed that a panel of the bib extends downwardly from the bottom edge of the pocket. Also, U.S. Pat. No. 4,261,057 which issued Apr. 14, 1981 to Karl G. B. Andersson discloses a bib construction comprising a full-width pocket which pocket has pleated end seams. Additionally, bibs having removable neck-opening panels are disclosed in U.S. Pat. Nos. 3,146,464 (above), and 4,233,688 which issued Nov. 18, 1980 to Joana Hjerl.

DISCLOSURE OF THE INVENTION

In accordance with one aspect of the invention, a bib is provided which comprises a top panel, a full-width pocket, and an apron panel which pendulously depends from the transverse upper edge of the front wall of the pocket. Additionally, a portion of the pocket panel of the bib (i.e., the front wall of the pocket) extends above the elevation of the top edges of the side seams of the pocket: i.e., the seams which secure the side edges of the pocket panel to adjacent portions of the side edges of the top panel of the bib. Also, preferably, face-to-face areas of the pocket panel and the apron panel disposed adjacent their coextensive upper edges are secured together to further enhance gravitational opening of the pocket when the bib is applied to a user. Preferably, such a bib is made to be disposable by fabricating it from a relatively inexpensive laminate comprising a liquid impervious backsheet; and an absorbent topsheet. Alternatively, it may, for example, be made from a plastic coated paper or plastic film coated with absorbent material such as papermaking or other absorbent fibers.

BRIEF DESCRIPTION OF THE DRAWINGS

While the specification concludes with claims which particularly point out and distinctly claim the subject matter regarded as forming the present invention, it is believed the invention will be better understood from the following description taken in conjunction with the accompanying drawings in which:

DETAILED DESCRIPTION OF THE INVENTION

Figure 1:
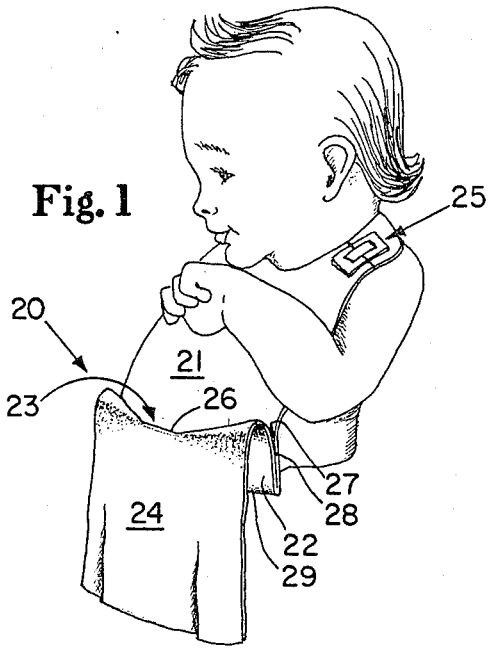
FIG. 1 is an in-use perspective view of a disposable bib which is an exemplary disposable bib embodiment of the present invention.

An exemplary bib which is a disposable embodiment of the present invention is designated 20 in FIG. 1. Bib 20 comprises top panel 21, pocket panel 22, a full-width pocket 23, and apron panel 24. As shown in FIG. 1, it has been fastened about the neck of a baby by fastening means 25 which may be a duplex tape-type fastener. The apron panel 24, FIG. 1, pendulously depends from the upper edge 26 of pocket panel 22; and the upper edge 26 is disposed at a higher elevation than the uppermost ends 27 of the side seams 28 of pocket 23. The bottom edge of pocket 23 is designated 29. As is also visible in FIG. 1, the centrally disposed portion of edge 26 is sharply defined whereas the remaining portions are somewhat rolled over. As will be described more fully below, these conditions/configurations of edge 26 are precipitated by securing together as with adhesive facing areas of the pocket panel 22 and the apron panel 24 which are disposed adjacent edge 26 and centrally with respect to the width of bib 20.

Briefly, as described above and as shown in FIG. 1, bib 20 has an apron panel which pendulously depends from the transverse upper edge of the front panel (i.e., wall) of a full width pocket; and the transverse upper edge is disposed at a higher elevation than the uppermost ends of the side seams of the pocket. In embodiments which comprise sufficiently crease sustaining sheet material, this configuration precipitates spontaneous gravitational opening of the pocket upon applying it to a user disposed in a conventional upright posture. In embodiments comprising less crease sustaining sheet material, centrally disposed areas of the pocket panel and the apron panel which are disposed adjacent their coextensive top edges are secured together in face-to-face relation with means such as adhesive. This provides more positive spontaneous gravitational opening of the pocket when the bib is placed in use as described above.

Bib 20 is preferably made to be disposable by virtue of being made from a unitary blank of a relatively inexpensive laminate comprising a plastic film backsheet (i.e., polyethylene), and an absorbent paper topsheet albeit it is not intended to thereby limit the present invention.

Figure 2:
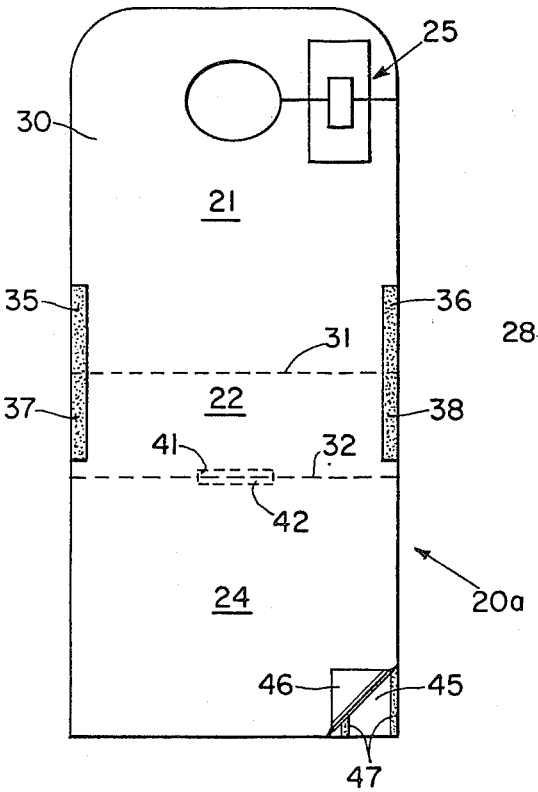
FIG. 2 is a plan view of a partially converted (i.e., partially manufactured) disposable bib which, when folded as shown, and seamed along the side edges of the pocket panel becomes a bib of the configuration shown in FIG. 1.

FIG. 2 is a plan view of a partially completed bib which is designated **20*a*, and which comprises a unitary blank 30, and duplex tape-type fastening means 25. The portion of the blank which is designated top panel 21 is demarked from the portion designated pocket panel 22 by the transverse dashed line 31, and the pocket panel 22 is demarked from the apron panel 24 by the transverse dashed line 32. Front surfaces of oppositely disposed side edge regions 35 and 36 of top panel 21, and oppositely disposed side edge regions 37 and 38 of pocket panel 22 are shown to be coated with contact adhesive or the like so that, when blank 30 is folded along line 31, regions 35 and 37 become seamed together in face-to-face relation and thereby form a side seam of the pocket 23. In the same vein, regions 36 and 38 form the oppositely disposed side seam 28 of the pocket upon folding blank 30 along line 31. Additionally, centrally disposed back surface regions 41 and 42 of pocket panel 22 and apron panel 24, respectively, which are disposed adjacent line 32 and also coated with a contact adhesive or the like so that, upon folding blank 29 along line 32, regions 41 and 42 become secured together in face-to-face relation. FIG. 2 also shows that regions 37 and 38 are spaced from line 32 by a distance greater than the vertical height of region 41. As is apparent, dashed lines 31 and 32 become bottom edge 29 and top edge 26, respectively, upon folding blank 30 along lines 31 and 32. Indeed, fold line 32 may in fact be a line-of-weakening to facilitate tear-off removal of the apron panel 24** for post-bib-use wipe up.

Unitary blank 30, FIG. 2, is a 2-ply laminate which comprises a liquid impervious backsheet 45 and an absorbent topsheet 46. Preferably, backsheet 45 is a thermoplastic film: for instance polyethylene having a thickness of from about one-half-mil (about 0.0127 mm) to about one-and-one-half mils (about 0.0381 mm). Also, preferably, the topsheet 46 comprises wet strength tissue paper having a basis weight of from about ten to about fifty pounds per three-thousand square feet (about 16.3 to about 81.5 grams per square meter). As shown by the peeled-back portion of topsheet 46 in FIG. 2, it is secured to backsheet 45 with a plurality of glue bead lines 47 albeit it is not intended to thereby limit the invention to any particular pattern or type of laminating means or to laminate per se.

Figure 3:
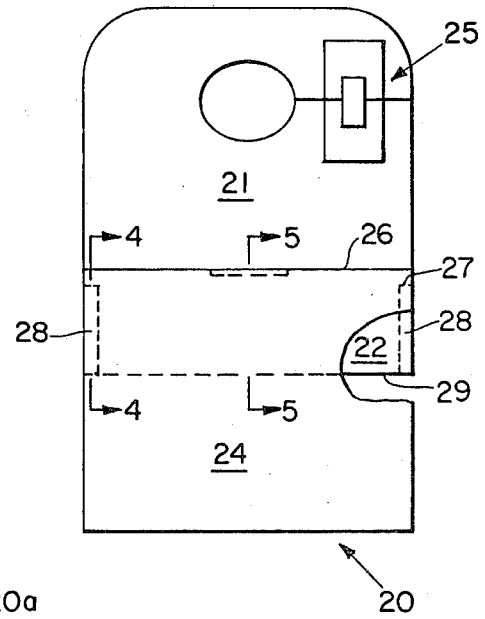
FIG. 3 is a plan view of the disposable bib of FIG. 1: i.e., of the partially converted bib of FIG. 2 after it has been folded along two transverse fold lines, and after all but top portions of the side edges of the pocket panel have been secured to edge portions of the top panel of the bib to form the side seams of the pocket.

FIG. 3 shows a bib 20 which as been made from the partially completed bib 20*a*, FIG. 2, by U-folding blank 30 along fold lines 31 and 32, and by securing the face-to-face juxtaposed pairs of regions 35 and 37, and 36 and 38 together as by adhesives or ultrasonic sealing or ply bonding means to form pocket end seams 28, only one of which end seams is shown in the partially torn away area of FIG. 3. Upon being so folded, fold line 31 in fact becomes the bottom edge 29 of pocket 23, FIG. 1; and fold line 32 in fact becomes the upper edge 26 of pocket panel 22 as stated hereinabove. As is also shown in FIG. 3, the uppermost ends 27 of the side seams 28 are spaced from the upper edge 26 as stated hereinbefore.

Figure 4:
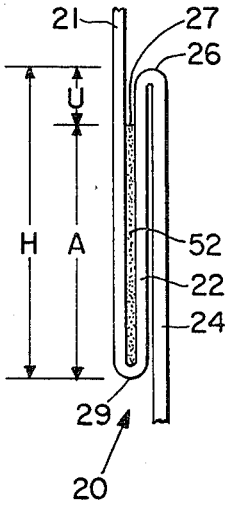
FIGS. 4 and 5 are enlarged-scale, fragmentary sectional views taken along section lines 4—4 and 5—5, respectively, of FIG. 3.

FIG. 4 is an enlarged scale fragmentary sectional view taken along line 4—4 of FIG. 3, and wherein the thickness of the sheet material and the side-seam adhesive 52 is exaggerated; and wherein the face-to-face portions of panels 21, 22, and 23 are spaced from each other for clarity whereas in fact they would not be so spaced apart in a bib as shown in FIG. 3. However, in FIG. 4, pocket panel 22 is shown to have a height designated H; and the height of the portion of pocket panel 22 secured by adhesive 52 is designated A. Thus, the portion of pocket panel 22 which extends upward from the elevation of the uppermost end 27 of the side seam (i.e., the top end of adhesive 52) to the top edge of 26 has a vertical (i.e., height) dimension designated U. Therefore, that portion of the pocket panel is cantilevered upward; and the apron panel pendulously depends from its top edge 26.

Figure 5:
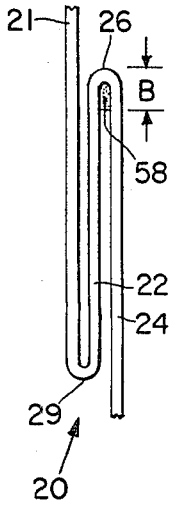

FIG. 5 is a fragmentary sectional view taken along line 5—5 of FIG. 3, and is in the same enlarged scale as FIG. 4. In FIG. 5, adhesive designated 58 is disposed to adhere in face-to-face relation juxtaposed regions of the pocket panel 22 and apron panel 24 which are adjacent top edge 26. The height of the bonded regions which are in fact regions 41 and 42, FIG. 2, is designated B in FIG. 5. Height B, FIG. 5, is less than height U, FIG. 4 so that the bottom edge of adhesive 58 is at higher elevation than the uppermost ends 27 of adhesive 52, FIG. 4. Thus, all of apron panel 24 which is not attached to pocket panel 22 pendulously depends from a higher elevation than the uppermost ends of the side seams of the pocket of the bib. This geometry precipitates spontaneous gravitational opening of the pocket when the bib is applied to a user as stated above.

An exemplary embodiment of bib 20 comprises a polyethylene film/paper laminate as described hereinbefore, and has the following features: an overall width and length of about twenty-eight (28) cm and forty-four (44) cm, respectively; a pocket panel having a height H, FIG. 4 of about nine (9) cm; an apron panel having a length of about twenty-two (22) cm; pocket side seams having vertical heights A, FIG. 4, of about seven-and-one-half (7½) cm; and central portions 41 and 42, FIG. 2, having transverse widths of about eight (8) cm, and vertical heights designated B, FIG. 5, of about one (1) cm albeit it is not intended to thereby limit the present invention by such nominal dimensions. However, the central portions have widths which are preferably up to about fifty (50) percent, and more preferably up to about twenty (20) percent of the width of the bib as measured along the transverse upper edge of the full-width pocket of the bib; and the vertical distance U, FIG. 4, is preferably from about one-half (0.5) to about one-and-one-half (1½) cm, and more preferably is about one (1) cm.

ALTERNATE EMBODIMENT

Bibs of the configuration described above may alternatively be provided without means such as the adhesive 58, FIG. 5, securing regions 41 and 42, FIG. 2, together in-face-to-face relation providing material of blank 30 is sufficiently crease sustaining when creased along line 32, FIG. 2, to comprise means for causing the apron panel to pendulously depend from above the elevation of the uppermost ends of the side seams of the pocket: for example, providing the sheet material from which the bib is made is sufficiently crease sustaining when folded and creased along line 32, FIG. 2 to precipitate such pendulous depending.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of the invention.

What is claimed is:

1. A bib comprising a top panel, a substantially full-width pocket panel disposed at the bottom end of said top panel, an apron panel, and means for securing said bib on a user, said pocket panel having a transverse upper edge and said apron panel having a transverse top edge which is coextensive with said transverse upper edge of said pocket panel so that said apron panel pendulously depends from said transverse upper part of said pocket, and said pocket panel having vertically extending side edges which are secured to adjacent edge regions of said top panel but for an unsecured zone of each said side edge disposed adjacent said transverse upper edge whereby said transverse upper edge is disposed at a higher elevation than the uppermost ends of the secured portions of said side edges, said bib further having a central surface portion of said pocket panel disposed adjacent said transverse upper edge secured in face-to-face relation to a central surface portion of said apron panel disposed adjacent said top edge thereof.

2. The bib of claim 1 wherein said top panel, said pocket panel and said apron panel are regions of a unitary sheet of material having an absorbent face and wherein adjacent said panels are demarked from each other by a transverse fold line, said transverse upper edge being coextensive with a first said transverse fold line which demarks said pocket panel from said apron panel.

3. The bib of claim 1 wherein the width of said central portion is up to about fifty percent of the width of said bib as measured along said transverse upper edge.

4. The bib of claim 1 wherein the width of said central portion is up to about twenty percent of the width of said bib as measured along said transverse upper edge.

5. The bib of claim 1 wherein the maximum vertical dimension of said secured central portion is no greater than the vertical distance between said transverse upper edge and said uppermost ends of said secured side edges.

6. The bib of claim 1 wherein the vertical distance between said transverse upper edge and said uppermost ends of said secured side edges is from about one-half centimeter to about one-and-one-half centimeters.

7. The bib of claim 6 wherein the vertical distance between said transverse upper edge and said uppermost ends of said secured side edges is about one-centimeter.

8. A bib comprising a top panel, a substantially full-width pocket panel disposed at the bottom end of said top panel, an apron panel, and means for securing said bib on a user, said pocket panel having a transverse upper edge and said apron panel having a transverse top edge which is coextensive with said transverse upper edge of said pocket panel so that said apron panel pendulously depends from said transverse upper edge of said pocket, said bib further having a central surface portion of said pocket panel disposed adjacent said transverse edge secured in face-to-face relation to a central surface portion of said apron panel adjacent said top edge.

* * * * *